United States Patent [19]

Pasternack

[11] Patent Number: 4,881,539

[45] Date of Patent: Nov. 21, 1989

[54] PROTECTIVE SUIT HAVING A SUPPLY OF BREATHING AIR

[75] Inventor: Adalbert Pasternack, Bad Schwartau, Fed. Rep. of Germany

[73] Assignee: Drägerwerk Aktiengesellschaft, Lübeck, Fed. Rep. of Germany

[21] Appl. No.: 31,938

[22] Filed: Mar. 27, 1987

[30] Foreign Application Priority Data

Mar. 27, 1986 [DE] Fed. Rep. of Germany ..... 3610491

[51] Int. Cl.[4] ..... B63C 11/02; A62B 17/00; A62B 7/00

[52] U.S. Cl. ..... 128/201.27; 128/201.29; 128/202.11; 128/202.14

[58] Field of Search ..... 128/201.29, 202.11, 128/202.14, 202.19, 201.27, 1 A, 205.10, 201.18, 211 R, 202.26; 2/211 S, DIG. 3; 600/20

[56] References Cited

U.S. PATENT DOCUMENTS

| | | | |
|---|---|---|---|
| 1,089,215 | 4/1913 | Roth | 128/202.14 |
| 3,284,808 | 11/1966 | Seeler | 600/20 |
| 3,461,855 | 8/1969 | Brown et al. | 128/1 A |
| 3,528,414 | 9/1970 | Schueller | 128/202.11 |
| 3,595,227 | 7/1971 | Parker | 2/211 R |
| 3,628,531 | 12/1971 | Harris | 128/202.11 |
| 3,698,289 | 3/1972 | Moreland | 128/201.27 |
| 3,730,178 | 5/1973 | Moreland | 128/201.27 |
| 3,911,913 | 10/1975 | June | 128/201.29 |
| 4,062,079 | 12/1977 | Potter | 128/201.27 |
| 4,294,242 | 10/1981 | Cowans | 128/202.19 |

FOREIGN PATENT DOCUMENTS

| | | | |
|---|---|---|---|
| 884611 | 7/1953 | Fed. Rep. of Germany | 128/202.14 |
| 1202141 | 5/1966 | Fed. Rep. of Germany . | |
| 782514 | 3/1935 | France | 128/201.29 |
| 204143 | 12/1967 | U.S.S.R. | 128/202.19 |

OTHER PUBLICATIONS

Haux, Gerald, "Touchtechnik", 1969, pp. 90–93.

*Primary Examiner*—Max Hindenburg
*Assistant Examiner*—K. M. Reichie
*Attorney, Agent, or Firm*—Walter Ottesen

[57] ABSTRACT

A protective suit has a supply of breathing air and includes a multiplicity of hollow chambers covering the body of the wearer which can be filled with breathing gas. The interiors of these chambers communicate with one another. The protective suit also includes hollow bodies which rest against the head, neck and upper torso region of a protective helmet portion. The interiors of these bodies communicate with those of the hollow chambers and with the interior of the protective helmet portion. The protective suit is configured for use for divers such that it is suitable not only for providing a sufficient volume for the supply of breathing gas and for thermal insulation but also, when it is filled, for first quickly pushing the diver up to the surface of the water and for providing a safe position of repose of the diver after ascent in which he can breathe freely, once he has reached the surface of the water. For this purpose, a source of breathing gas is connected to the hollow bodies and the connection between the hollow bodies and the hollow chambers is provided by a pretensioned transition element. In addition, the hollow chambers have an outlet which communicates with the interior of the protective helmet via a further pretensioned transition element. The opening pressure of the first-mentioned transition element is less than the opening pressure of the second-mentioned transition element.

6 Claims, 1 Drawing Sheet

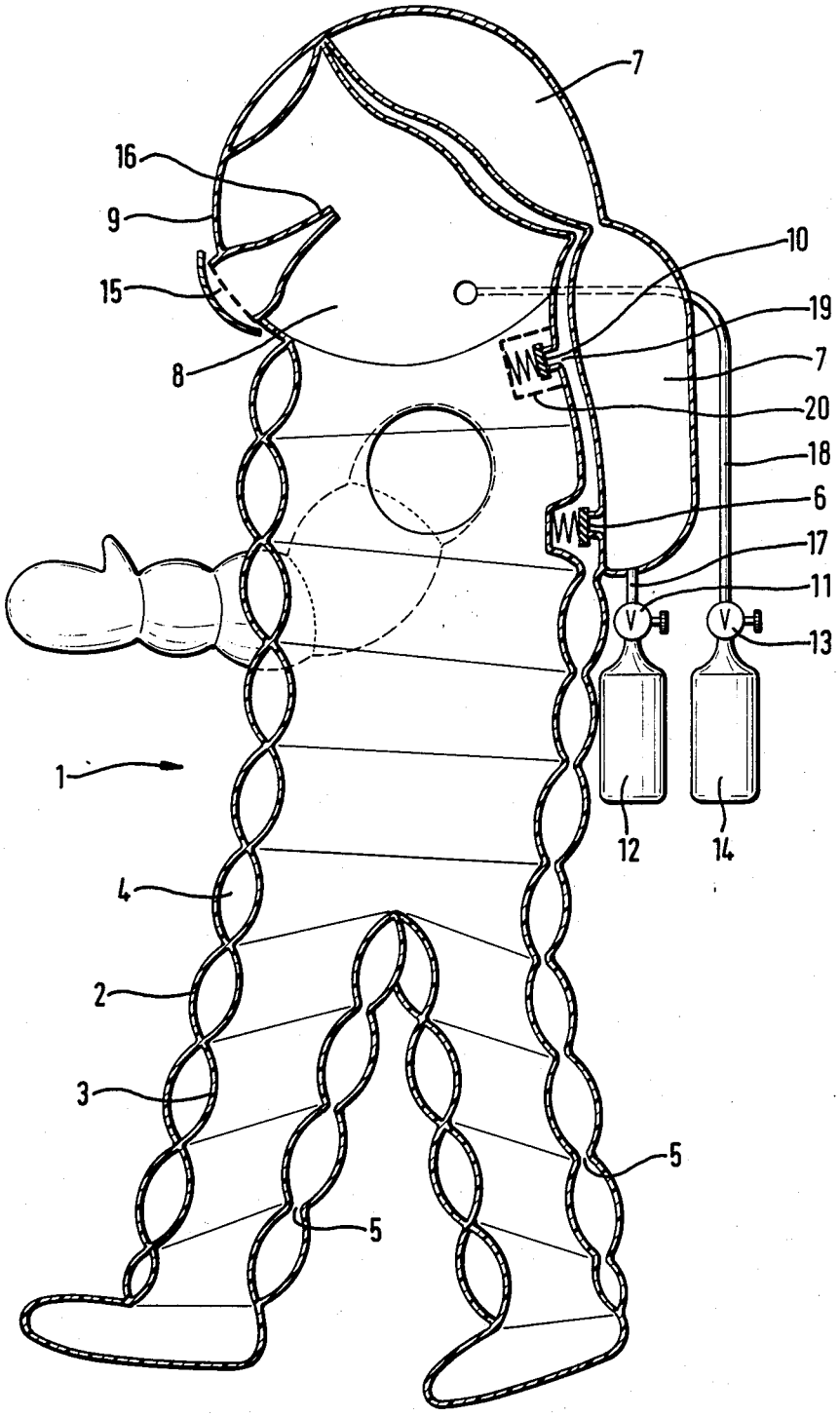
7
16
9
15
8
10
19
7
20
18
6
17
11
13
1
12
14
4
2
3
5
5

PROTECTIVE SUIT HAVING A SUPPLY OF BREATHING AIR

FIELD OF THE INVENTION

The invention relates to a protective suit having a supply of air for breathing. The protective suit includes a multiplicity of hollow chambers covering the body of the wearer which are fillable with breathing gas. The interior spaces of these chambers communicate with one another. The protective suit includes also hollow bodies which are next to the head, neck and upper torso portion of a protective helmet with the interior spaces of the hollow bodies communicating with those of the hollow chambers and with the interior of the protective helmet.

BACKGROUND OF THE INVENTION

A protective suit of this kind is described in German Pat. No. 12 02 141. The protective suit described in this patent has hollow spaces capable of receiving breathing gas therein which enters from these hollow spaces into the breathing space of the helmet of the protective suit. The hollow spaces are formed as rigid-walled, double-shell chambers separated from one another by ribs and these chambers communicate with one another by means of suitable openings and thus form a reservoir for the breathing gas. A plurality of chambers are combined in regions that are pivotably connected with one another by suitable couplings and are provided with check valves at their connecting openings. In the event of leakage in one of the combined regions, these check valves prevent the supply of breathing gas from entering such a region from an undamaged region which would allow the entire supply of breathing gas to escape via this leak.

The protective suit disclosed in German Pat. No. 12 02 141 is intended to supply its wearer with fresh air for breathing in an environment in which the air is not breathable and to simultaneously seal off the respiratory organs from the undesirable penetration of harmful ambient air.

This kind of protective suit is suitable for use in air, but it cannot be used as a protective suit for divers. The hollow chambers that can be filled with breathing air in a protective suit of the kind described above are uniformly distributed over the entire body surface of the person wearing the suit, and as a diver ascended, these hollow chambers would push upward more or less uniformly against all the parts of the body, so that a preferred upright position of the body during the ascent would not be assured. Furthermore, it cannot be assured that once a diver has ascended, the diver will remain with the head above the water because, as a result of the more or less uniformly distributed forces of buoyancy on the body, a stable balanced position in which the head protrudes from the surface of the water is not assured. Yet such a position is a necessity, particularly for unconscious divers.

When the protective suit is first filled under water, as may for instance be necessary in rescue of the crew of a submarine, the known protective suit requires waiting until such time as the entire volume of the hollow chambers in the protective suit has filled with the breathing gas. During the ascent and once the surface of the water has been reached, exhalation of the breathing air stored in the hollow chambers is possible only to a limited extent, and only as long as sufficient buoyancy of the still-filled protective suit prevents the diver from sinking again.

SUMMARY OF THE INVENTION

It is the object of the invention to provide a protective suit of the kind described above which is suitable for use with divers so that it enables an upright ascent of the diver to the surface of the water even while the hollow chambers are still being filled with breathing gas. It is a further object of the invention to provide a protective suit that also has sufficient reserves of breathing gas for a longer duration of breathing even at the surface of the water and provides long-lasting thermal protection during the ascent as well as in the event that a relatively long time is spent at the surface while at the same time maintaining a stable position of repose.

The protective suit of the invention includes a helmet having head and neck regions; a plurality of hollow chambers fillable with breathing air and adapted to surround the body of a wearer of the suit, the hollow chambers having respective hollow interiors and being interconnected to cause these interiors to communicate one with the other; a plurality of hollow bodies also fillable with breathing gas and being arranged in the head, neck and upper torso regions of the suit; the hollow bodies having respective hollow interiors communicating with the interior of the helmet and the respective interiors of the hollow chambers; breathing gas supply means connected to the hollow bodies for supplying breathing gas thereto; first pretensioned transition means interposed between the hollow bodies and the hollow chambers for permitting breathing gas to pass from the hollow bodies to the hollow chambers; second pretensioned transition means interposed between the hollow chambers and the interior of the suit for permitting breathing gas to pass from the hollow chambers to the interior of the helmet; and, the first pretensioned transition means being configured to open in response to a first pressure of the breathing gas and the second pretensioned transition means being configured to open in response to a second pressure of the breathing gas, the first pressure being less than the second pressure.

Thus, according to a feature of the invention, a source of breathing gas is connected to the hollow bodies and a first pretensioned transition element interconnects the hollow bodies and the hollow chambers. According to another feature of the invention, the hollow chambers have an outlet opening which communicates with the interior of the protective helmet via a second pretensioned transition element to provide breathing air to the person wearing the suit. The opening pressure of the first transition element is less than the opening pressure of the second transition element.

The advantages attained with the invention are primarily that when the protective suit is filled, the hollow bodies are filled first and thus serve directly as buoyancy-promoting bodies in the head area of the wearer of the protective suit and assure that a diver ascends toward the surface of the water in the correct orientation. Only once the hollow bodies have been filled to the fill pressure determined by the opening pressure of the first transition element are the remaining hollow chambers that surround the body of the person wearing the protective suit filled with breathing gas, so that these chambers serve as thermal insulation bodies and as a breathing gas reservoir. Only once these hollow chambers have been filled to the fill pressure determined by the second pretensioned transition element does the breathing gas pass from the interiors of the hollow chambers into the interior of the protective helmet. As a rule, the filling of the hollow chambers and hollow bodies is completed so quickly that the wearer of the protective suit already has breathing gas available for breathing in a sufficiently short time at the beginning of the ascent period.

According to a further feature of the invention, an additional source of breathing gas, for instance one filled with oxygen, is connected directly to the protective helmet. This provision may be particularly advantageous, for example, if after an ascent to the surface of the water, breathing from the supply of breathing gas must be done for a relatively long period, in which case the thermal insulation action of the hollow chambers must be maintained.

In a particularly simple embodiment of the invention, the transition elements can be provided in the form of spring-loaded check valves.

Pursuant to a further feature of the invention, the hollow chambers and the hollow bodies are configured as a double-walled cell structure of elastic foil. This embodiment makes it possible to pack the protective suit into a small volume when it is not in use and to unfold it and put it on only when needed.

According to still a further feature of the invention, the protective helmet can be provided with an inhalation valve. This assures that the wearer of the protective suit can breathe in and out from the ambient air even after the reservoir of breathing gas has been exhausted.

The inhalation valve can be configured as an overflow protective device such as a water trap, float valves or a combination of these elements, and a mouthpiece valve.

BRIEF DESCRIPTION OF THE DRAWING

The invention will now be described with reference to the single drawing FIGURE which is a schematic of the protective suit according to a preferred embodiment of the invention.

DESCRIPTION OF THE PREFERRED EMBODIMENTS OF THE INVENTION

The protective suit 1, in the region surrounding the body of the wearer of the suit, includes an elastic double foil (2, 3) which is heat-fused into a plurality of annular hollow chambers 4. In the rear portion of the suit, these hollow chambers 4 communicate with one another via gap-like openings 5. The annular hollow chambers 4 have an outlet opening 19 by means of which they communicate via a transition element 10 with the interior 8 of a protective helmet 9. The transition element 10 is mounted on the inner foil 3 and is configured as a spring-loaded check valve through which the person wearing the suit is supplied with breathing air. The box 20 surrounding the check valve 10 is drawn with a broken line to emphasize that the breathing air goes directly into the interior of the suit and helmet occupied by the person wearing the suit.

The protection helmet 9 is rigid and forms a unit together with the body portion thereof. Hollow bodies 7 are provided at the head, neck and upper torso region of the protective suit 1 and are separate chambers for air to ensure that the head of the person wearing the suit is kept above water. The hollow bodies 7 are connected to hollow chambers 4 via a transition element 6 which is also configured as a spring-loaded check valve. When the pressure in hollow bodies 7 has reached a predetermined level, then the air will pass through valve 6 to the remaining interconnected chambers 4 of the suit.

The hollow bodies 7 are connected to a source of breathing gas 12 via a connecting line 17 and a metering valve 11. The source of breathing gas can be in the form of a compressed-air bottle 12. An additiional source of breathing gas in the form of an oxygen bottle 14 communicates via a further metering valve 13 and a connecting hose 18 with the interior 8 of the protective helmet 9. The protective helmet 9 has an inhalation valve used for breathing; this valve includes an overflow protection means 15 and a mouthpiece valve 16. The helmet is also provided with an exhalation valve (not shown) which could be of the kind shown in the book "Tauchtechnik" by Gerhard Haux (Springer-Verlag, N.Y. 1969) on page 92.

It is understood that the forgoing description is that of the preferred embodiments of the invention and that various changes and modifications may be made thereto without departing from the spirit and scope of the invention as defined in the appended claims.

What is claimed is:

1. A protective suit comprising:

a helmet portion having head and neck regions adapted to enclose the entire head and neck of a wearer;

a body portion adapted to enclose the body of the wearer therein, said body portion being connected to said helmet portion and comprising a plurality of hollow chambers fillable with breathing gas and adapted to surround the body of the wearer of the suit, said hollow chambers having respective hollow interiors and being interconnected to cause said interiors of said hollow chambers to communicate one with the other;

a plurality of hollow bodies fillable with breathing gas and being arranged on said suit in the head, neck and upper torso regions thereof;

said hollow bodies having respective hollow interiors and being interconnected so as to cause said hollow interiors to communicate one with the other;

breathing gas supply means connected to said hollow bodies for supplying breathing gas thereto;

first pretensioned transition means interposed between said hollow bodies and said hollow chambers for permitting breathing gas to pass from said hollow bodies to said hollow chambers;

second pretensioned transition means interposed between said hollow chambers and the interior of said helmet portion for permitting breathing gas to pass from said hollow chambers to said interior of said helmet portion; and, said first pretensioned transition means being configured to open in response to a first pressure of the breathing gas and said second pretensioned transition means being configured to open in response to a second pressure of the breathing gas, said first pressure being less than said second pressure.

2. The protective suit of claim 1, comprising second breathing gas supply means connected to said helmet portion.

3. The protective helmet of claim 1, said first pretensioned transition means and said second pretensioned transition means being respective spring-loaded check valves.

4. The protective suit of claim 1, including two adjacent coextensive layers of elastic foil interconnected to define said hollow chambers and said hollow bodies.

5. The protective suit of claim 1, said helmet portion having inhalation valve means mounted thereon.

6. The protective suit of claim 5, said inhalation valve means including mouthpiece valve means mounted in said helmet portion and, overflow protection means for said mouthpiece valve means.

* * * * *